United States Patent [19]

Milberger et al.

[11] Patent Number: 4,928,769

[45] Date of Patent: May 29, 1990

[54] CASING HANGER RUNNING TOOL USING STRING WEIGHT

[75] Inventors: Lionel J. Milberger, Houston, Tex.; Philippe C. Nobileau, Paris, France; Bruce J. Watkins, Houston, Tex.

[73] Assignee: Vetco Gray Inc., Houston, Tex.

[21] Appl. No.: 286,603

[22] Filed: Dec. 16, 1988

[51] Int. Cl.[5] ..... E21B 23/02; E21B 43/10

[52] U.S. Cl. ..... 166/382; 166/82; 166/182; 166/242; 166/387

[58] Field of Search ..... 166/387, 381, 382, 383, 166/82, 86, 88, 182, 348, 358, 368, 208, 212, 217; 285/18, 140, 141, 133.2

[56] References Cited

U.S. PATENT DOCUMENTS

| | | | |
|---|---|---|---|
| 3,897,823 | 8/1975 | Ahlstone | 166/20 |
| 3,933,202 | 1/1976 | Ahlstone | 166/182 |
| 4,674,576 | 6/1987 | Goris et al. | 166/382 |
| 4,712,621 | 12/1987 | Wightman et al. | 166/382 |
| 4,736,799 | 4/1988 | Ahlstone | 166/348 |
| 4,757,860 | 7/1988 | Reimert | 166/208 |
| 4,811,784 | 3/1989 | Theiss | 166/382 |

*Primary Examiner*—Stephen J. Novosad
*Assistant Examiner*—Terry Lee Melius
*Attorney, Agent, or Firm*—James E. Bradley

[57] ABSTRACT

A tool for setting a packoff between the casing hanger and the wellhead utilizes differential area pistons. The tool has a mandrel which connects to a string of drill pipe. The mandrel carries a body and is axially movable relative to the body. A setting sleeve is carried by the body for connection to the packoff. A setting sleeve piston is carried by the body for relative movement relative to the body. A mandrel piston is carried by the mandrel for movement with the mandrel. Passages in the body communicate the mandrel piston with a setting sleeve piston and contain an incompressible fluid. Downward movement of the mandrel causes the pressure to increase to drive the setting sleeve piston downward to set the packoff.

8 Claims, 13 Drawing Sheets

CASING HANGER RUNNING TOOL USING STRING WEIGHT

BACKGROUND OF THE INVENTION

1. Field of the Invention

This invention relates in general to tools for running casing hangers in subsea wells, and in particular to a tool that utilizes pressure intensification through differential area pistons to set the packoff for a casing hanger.

2. Description of the Prior Art

The subsea well of the type concerned herein will have a wellhead supported on the subsea floor. One or more strings of casing will be lowered into the wellhead from the surface, each supported on a casing hanger. The casing hanger is a tubular member that is secured to the threaded upper end of the string of casing. The casing hanger lands on a landing shoulder in the wellhead, or on a previously installed casing hanger having larger diameter casing. Cement is pumped down the string of casing to flow back up the annulus around the string of casing. After the cement hardens, a packoff is positioned between the wellhead bore and an upper portion of the casing hanger. This seals the casing hanger annulus.

One type of packoff proposed utilizes a metal seal so as to avoid deterioration with time that may occur with elastomeric seals. Metal seals require a much higher force to set than elastomeric seals. Prior art running tools have employed various means to apply the downward force needed to set the packoff. Some prior art tools use rotation of the drill string to apply setting torque. It is difficult to achieve sufficient torque to generate the necessary forces for a metal packoff, because the running tool may be located more than a thousand feet below the water surface in deep water.

Other running tools and techniques shown in the patented art apply pressure to the annulus surrounding the drill string on which the running tool is suspended. The amount of annulus pressure is limited, however, to the pressure rating of the riser through which the drill string extends, which is normally not enough to set a metal packoff.

Higher pressures can be achieved by pumping through the drill string. However, this requires a running tool with some type of ports that are opened and closed from the surface. This is necessary because cement must first be pumped down the drill string. The ports may be open and closed by dropping a ball or dart. This requires a considerable amount of time, however, for the ball to reach the seat. Rig time is quite expensive. Another method employs raising and lowering the drill pipe and rotating in various manners to engage and disengage J-slots to open and close ports. This has a disadvantage of the pins for the J-slots wearing and not engaging properly.

SUMMARY OF THE INVENTION

In this invention, the drill string weight is used to set the packoff. The drill string weight, itself, does not have sufficient force to set the packoff. The force due to the drill string weight is intensified by using differential pistons. The running tool has a mandrel that is connected to the drill string. The mandrel has a mandrel piston that moves with the mandrel. The mandrel carries a body that engages the casing hanger. The body has a setting sleeve piston that has a much larger pressure area than the mandrel piston. Sealed hydraulic passages connect the chamber of the mandrel piston with the chamber of the setting sleeve piston.

When setting the packoff, as the drill string is lowered relative to the body, the mandrel piston will apply hydraulic pressure to the liquid contained in the passages. This pressure acts on the setting sleeve piston, which in turn applies a downward force on the setting sleeve. The downward force of the setting sleeve will be much higher than the direct force from the weight of the drill string because of the intensification due to the differential area pistons.

Preferably the body has two parts, an upper body and a lower body. The upper body is carried in an upper position while running the casing hanger and while cementing. Then, the mandrel and the upper body are lowered relative to the lower body to position the packoff assembly in the annular space between the casing hanger and wellhead. Then, the mandrel is lowered relative to both the upper body and lower body to apply hydraulic pressure to the setting sleeve piston.

DESCRIPTION OF THE PREFERRED EMBODIMENT

Figure 1A:
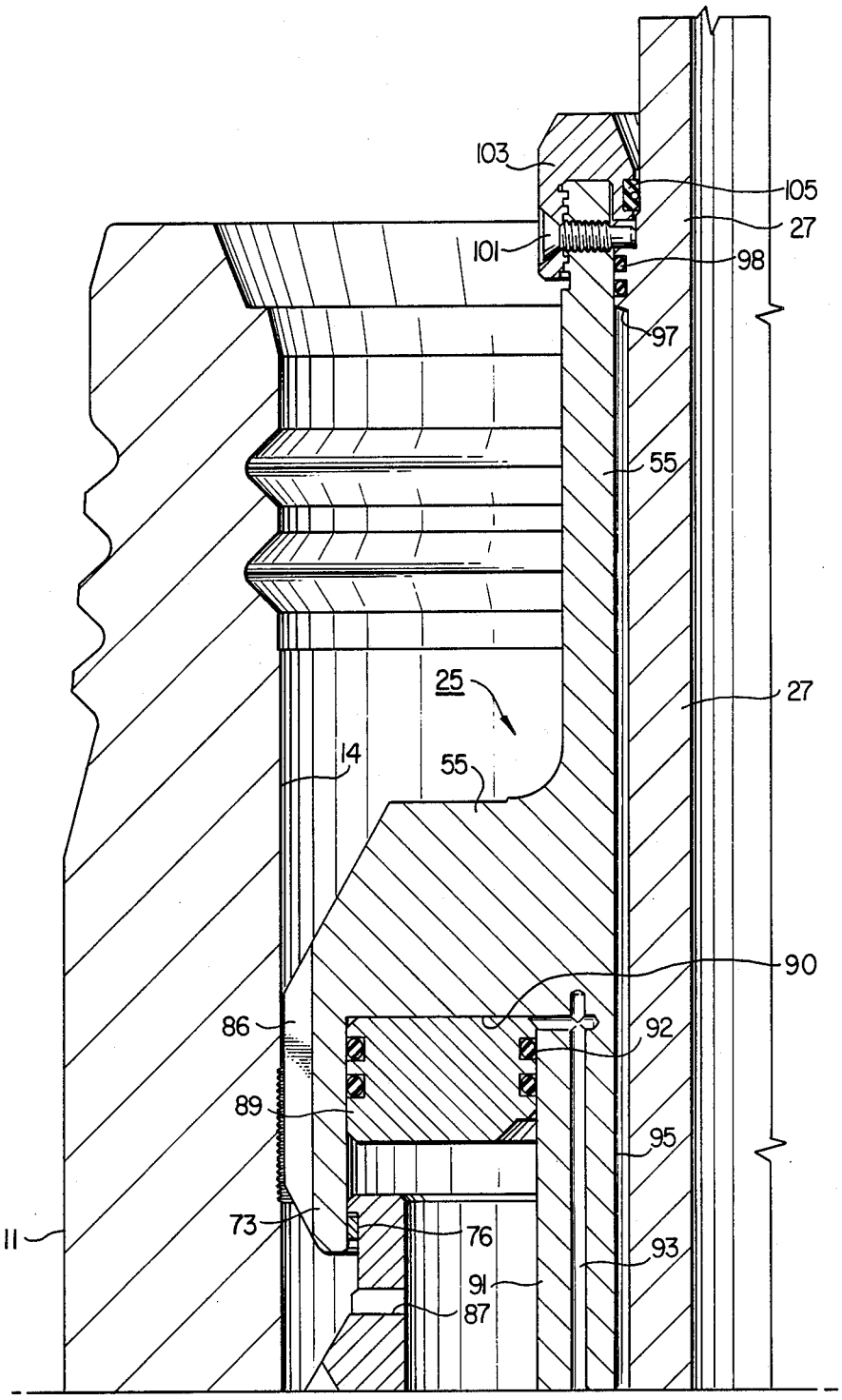
FIGS. 1*a* and 1*b* are quarter sectional views of a running tool constructed in accordance with this invention, and shown in the running in and cementing position.
Figure 1B:
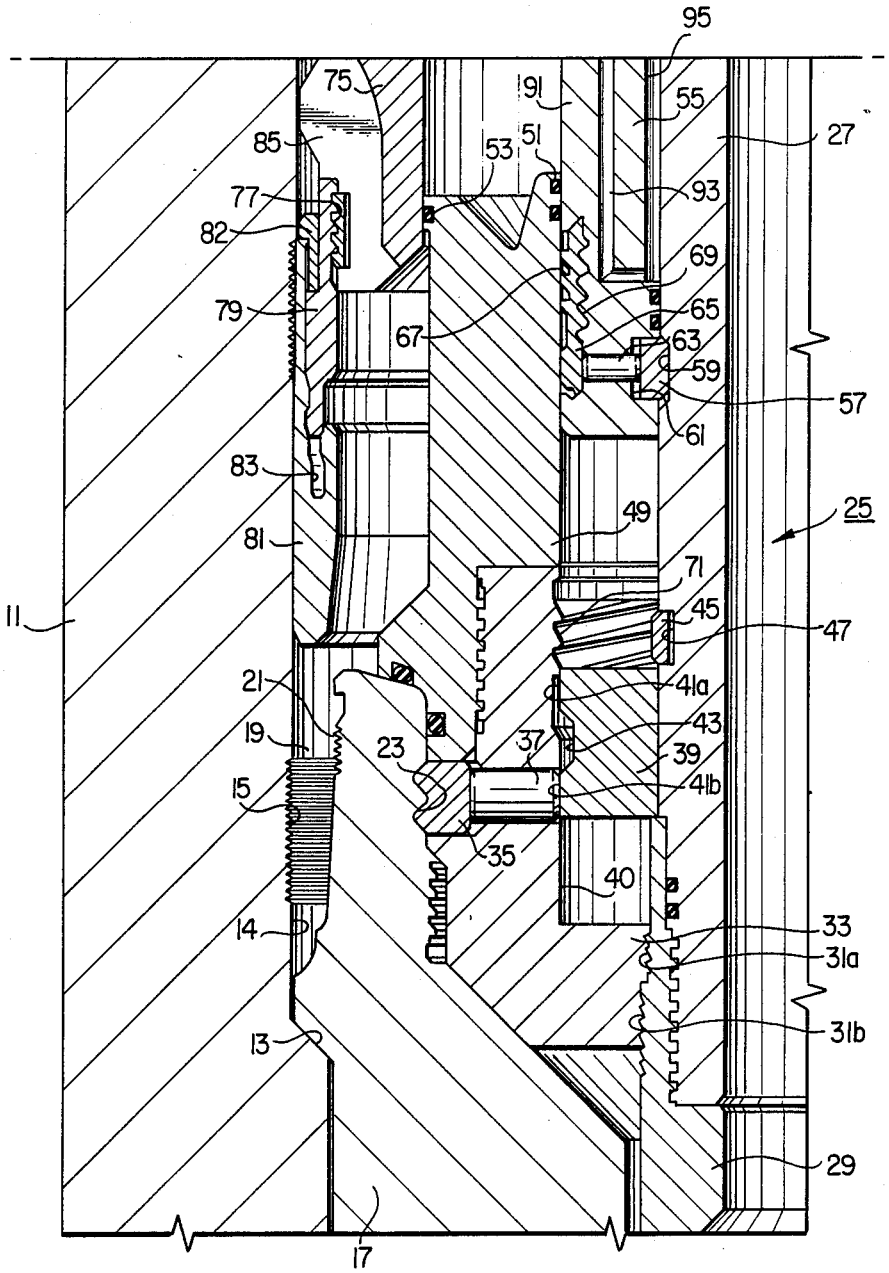

Referring to FIGS. 1*a* and 1*b*, and more particularly to FIG. 1*b*, wellhead 11 is a tubular member extending upward from the subsea floor. An internal landing shoulder 13 is located in the bore 14 of the wellhead 11. Landing shoulder 13 is frustoconical. A set of wickers 15 is located a short distance above the landing shoulder 13. Wickers 15 are small, parallel, circumferential grooves.

A casing hanger 17 lands on the landing shoulder 13. Casing hanger 17 is a tubular member that is secured to the upper end of a string of casing (not shown). An annular clearance 19 exists between an upper portion of the casing hanger 17 and the bore 14 of the wellhead 11. A set of wickers 21 is formed on the casing hanger 17. Wickers 21 are of the same configuration, but extend upward farther and do not extend as far down as the wellhead wickers 15. Two large circumferential grooves 23 are located on the inner diameter of the upper portion of the casing hanger 17.

Figure 3A:
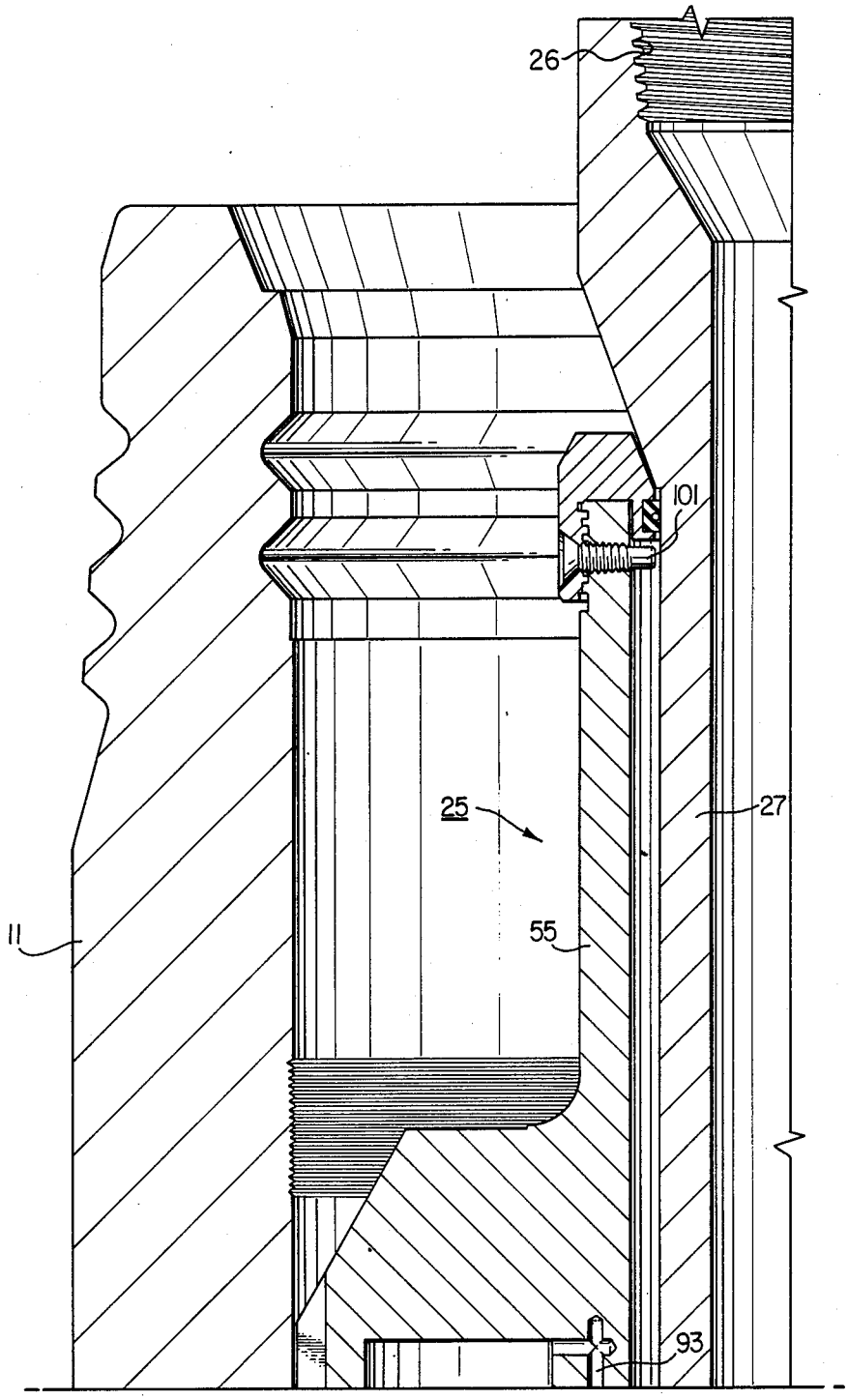
FIGS. 3*a* and 3*b* are quarter sectional views of the running tool of FIG. 1, showing the packoff when fully set, with the mandrel in the lowermost position.

Casing hanger 17 is lowered into place and set by a running tool 25. Running tool 25 includes a mandrel 27 that has an upper end containing threads 26 (FIG. 3*a*) for connection to the lower end of the string of drill pipe (not shown). The drill pipe will be lowered through a riser (not shown) that extends from a floating vessel down to the wellhead 11. A collar 29 is secured to the lower end of the mandrel 27. Collar 29 has exterior threads 31*a*, 31*b*. The threads 31*b* are of larger diameter than the threads 31*a*. The threads 31*a*, 31*b* are adapted to screw into mating threads formed in a lower body 33.

An engaging element, preferably a split ring 35, is carried by the lower body 33. The ring 35 will extend from the exterior of the lower body 33. The ring 35 has a pair of annular bands separated by a groove on the outer side. The bands are adapted to mate with the grooves 23 in the casing hanger 17 to secure the lower body 33 to the casing hanger 17. Ring 35 will move between an extended position shown in FIG. 1*b* to a retracted position shown in FIG. 5*b*.

A plurality of linking pins 37 extend through the lower body 33 radially inward from the ring 35. The linking pins are moved inward and outward by a cam 39, which is a solid ring. Cam 39 is carried inside a cavity 40 in the lower body 33. Cam 39 has a pair of lobes 41*a*, 41*b*, which are annular bands separated by a central recess 43. The cam 39 will move axially relative to the lower body 33.

Figure 5A:
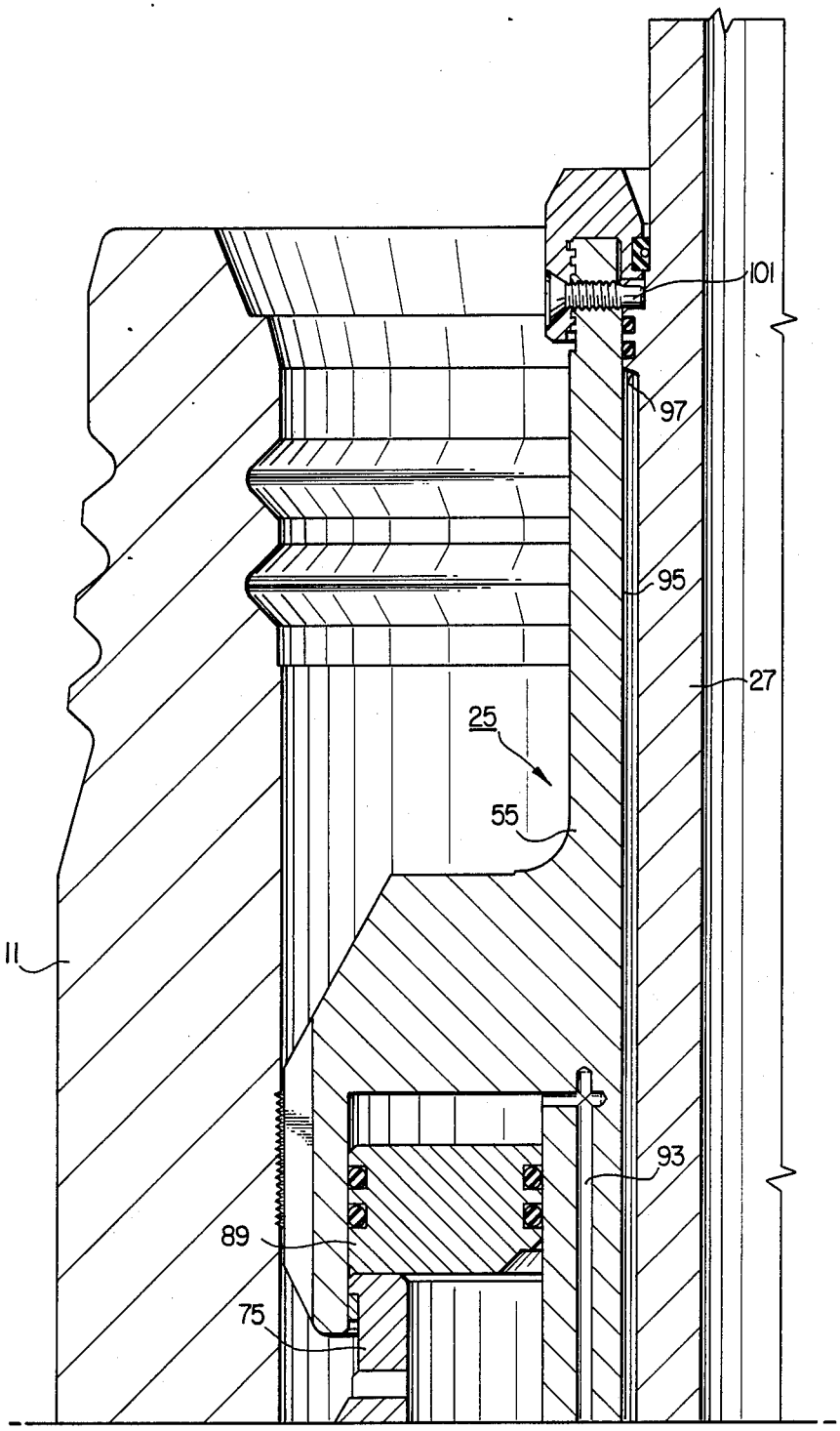
FIGS. 5*a* and 5*b* are quarter sectional views of the running tool of FIG. 1, showing the running tool released from the casing hanger after the packoff has been set.
Figure 5B:
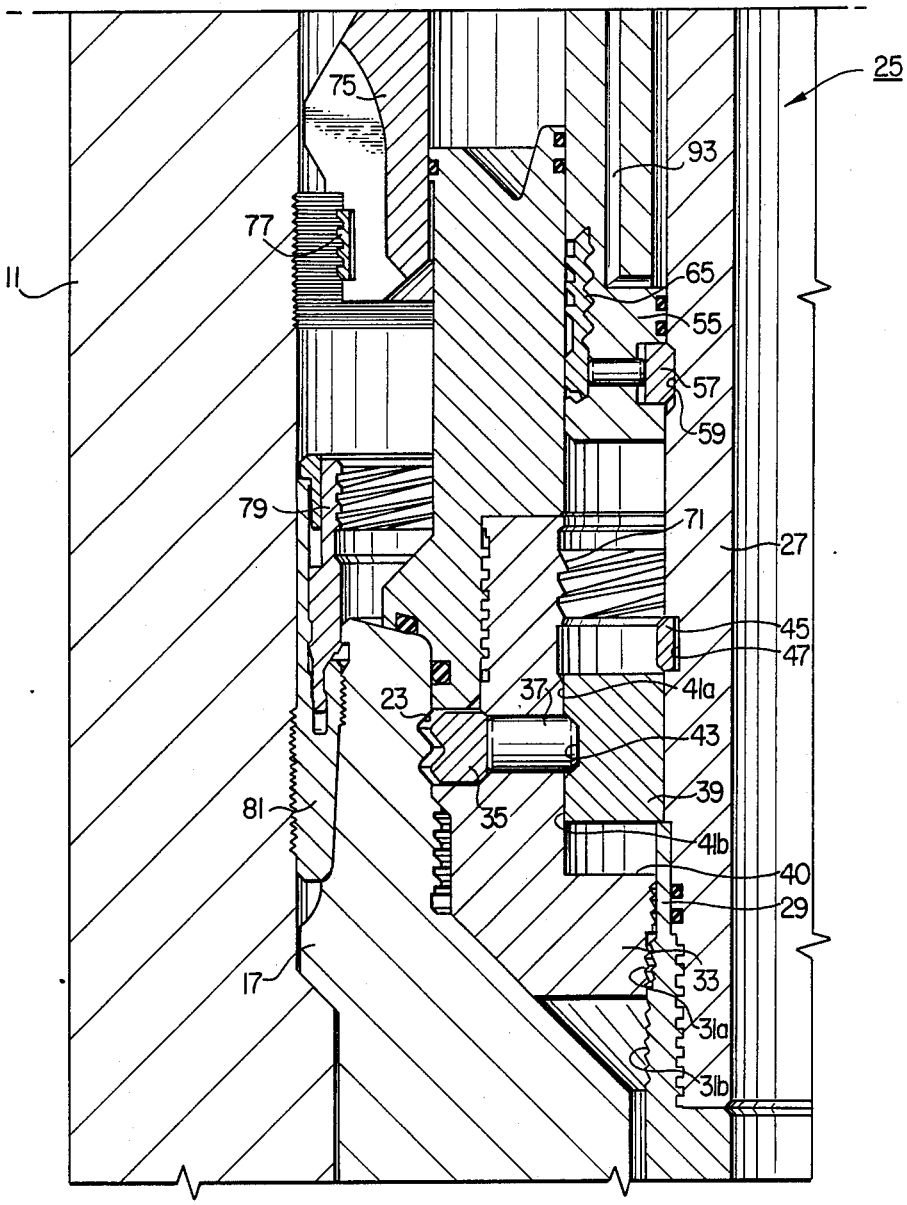
Figure 6:
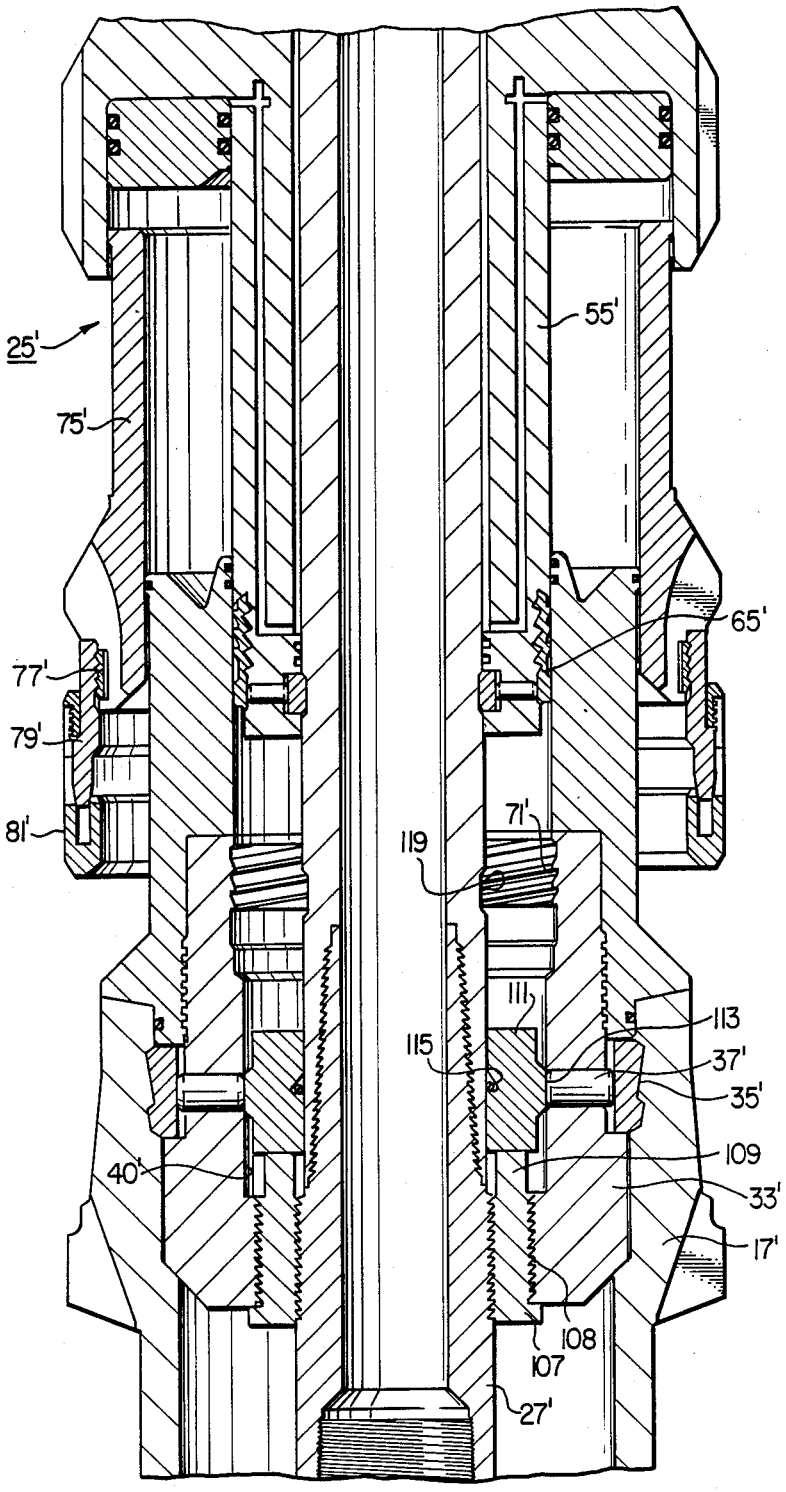
FIG. 6 is a partial vertical sectional view of an alternate embodiment of a running tool constructed in accordance with this invention and shown in the running in position.

FIG. 1*b* sows the cam 39 in an upper position with the lower lobe 41*b* pressing the linking pins 37 and the ring 35 outward. FIG. 2*b* shows the cam 39 in a lower position, with the upper lobe 41*a* pressing the linking pins 37 and the ring 35 outward. FIG. 5*b* shows the cam 39 in an intermediate position, with the recess 43 engaging the linking pins 37, which allows the ring 35 to retract. The cam 39, linking pins 37 and ring 35 serve as connection means for releasably connecting the running tool 25 to the casing hanger 17.

The cam 39 is moved downward by retention means comprising a split ring 45 secured in a recess 47 in the mandrel 27. Split ring 45 bears against the upper end of the cam 39 to cause the cam 39 to move downward with the mandrel 27. The flexibility of the split ring 45 allows it to retract into the recess 47 and slide past the cam 39 when the cam is located in the lower position bearing against the bottom of the cavity 40. In FIG. 2*b*, the split ring 45 is located a considerable distance below the cam 39.

The cam 39 moves back to the intermediate position by means of the collar 29, as shown in FIG. 1*b*. The collar 29 has an upper edge that engages the lower end of the cam 39. When the collar 29 is fully screwed into the lower body 33, the upper end of the collar supports the cam 39 in the upper position. In the position of FIG. 5*b*, the threads 31*a* and 31*b* have contacted the mating threads in the lower body 33, but have not yet been screwed into place. In this position, the upper end of the collar 29 supports the cam 39 in the intermediate position.

The lower body 33 is preferably constructed in two parts, the upper portion 49 being secured by threads to the lower portion. Ring 35 locates in an annular space between the lower body 33 and its upper portion 49. The upper portion 49 of the lower body extends upward concentric with the mandrel 27. Inner and outer seals 51, 53 are located on the inner and outer diameters of this lower body upper portion 49.

Referring to FIG. 1*a*, the running tool 25 has an upper body 55. Upper body 55 has an upper position relative to the lower body 33 that is shown in FIGS. 1*a* and 1*b* and also in FIGS. 5*a* and 5*b*. In the other figures, the upper body 55 is located in a lower position relative to a lower body 33. The upper body 55 is maintained in the upper position during running in and cementing by a locking element comprising a split ring 57 which is shown in FIG. 1*b*.

When the upper body 55 is in the upper position, split ring 57 locates in a recess 59 formed on the outer diameter of the mandrel 27. In both the upper and lower positions of the upper body 55, split ring 57 remains located in a cavity 61 contained in the lower portion of the upper body 55. Cavity 61 has a radial width that is at least as wide as the radial thickness of the split ring 57 so as to allow the split ring 57 to expand outward into the cavity 61. This allows the split ring 57 to move out of the mandrel recess 59 as shown in FIG. 2*b*, to enable the mandrel 27 to be lowered relative to the upper body 55.

A plurality of pins 63 extend radially outward from split ring 57. Pins 63 engage a latch ring 65 that is also split. Latch ring 65 has outer threads 67 and inner grooves 69. The inner grooves 69 engage mating grooves in the upper body 55 to retain the latch ring 65 with the upper body 55. The latch ring threads 67 are configured to ratchet past and engage mating threads 71 formed in the upper portion of the casing hanger cavity 40. The threads 67, 71, are of a sawtooth configuration.

Figure 2B:
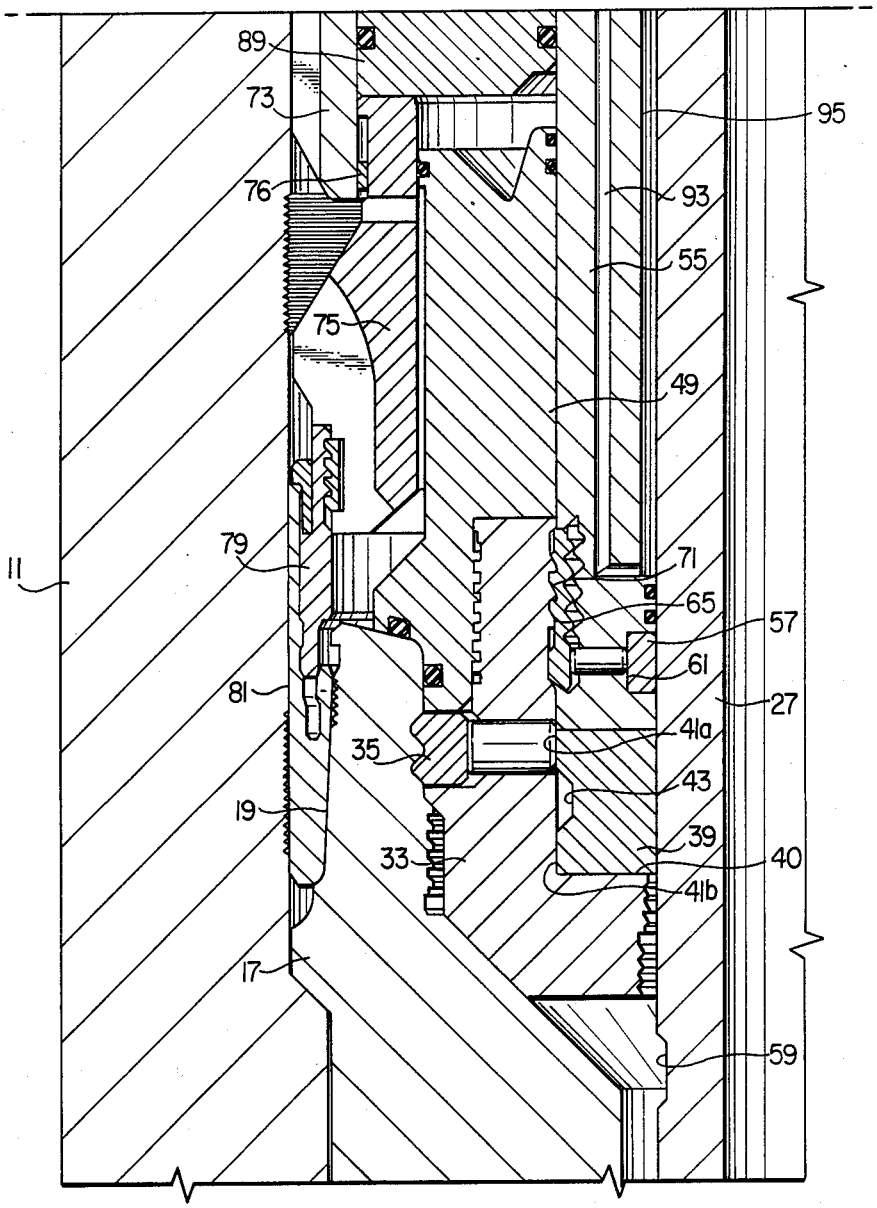
Figure 3B:
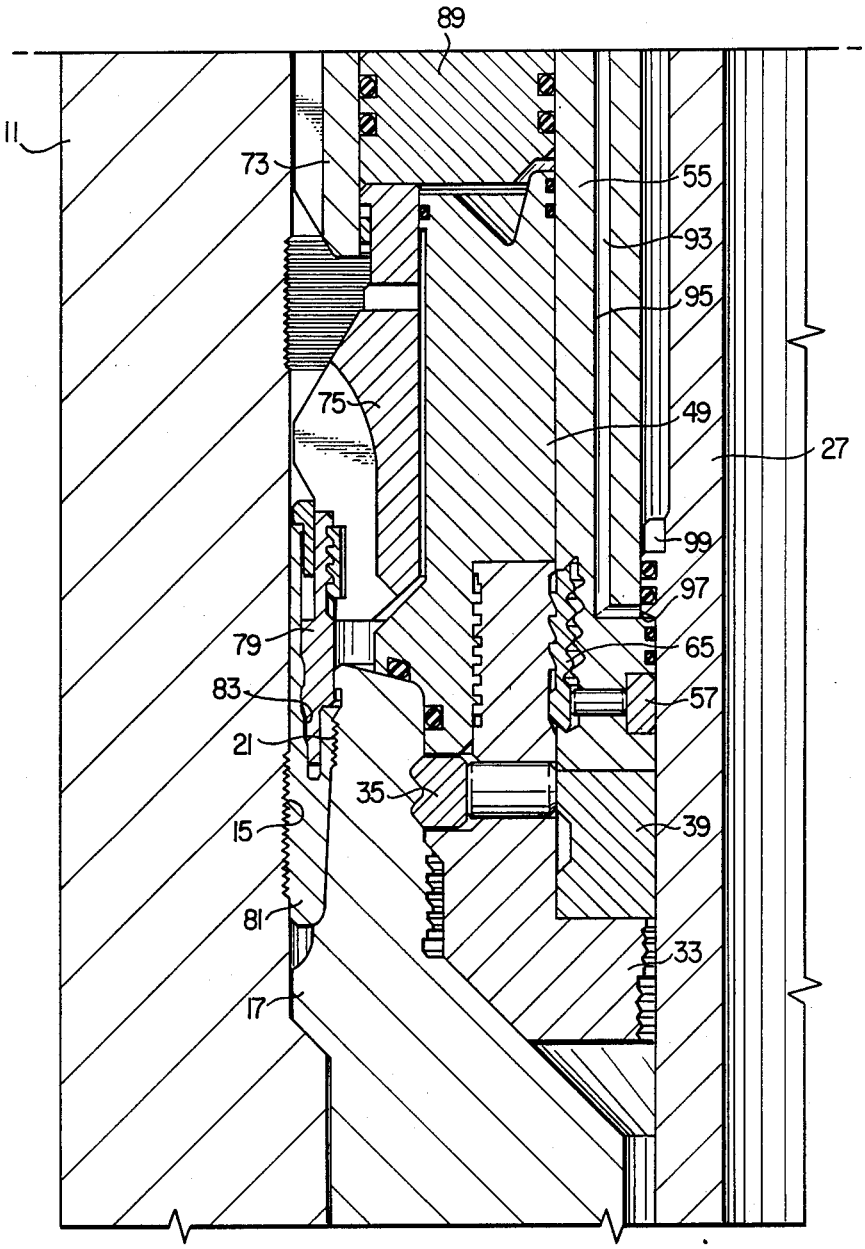

In FIG. 1*b*, the latch ring 65 is positioned above the casing hanger threads 71. In FIGS. 2*b* and 3*b*, the latch ring 65 is engaging the threads 71. When engaging the threads 71, the latch ring 65 expands outward. The pins 63 move outward, allowing the split ring 57 to move outward. This withdraws the split ring 57 from the recess 59. While engaging the threads 71, the grooves 69 move outward to some extent from the mating grooves in the upper body 55, but still remain in engagement. The latch ring 65 and associated elements serve as means for latching the upper body 55 to the lower body 33 when the upper body 55 is in the lower position, to prevent any axial movement of the upper body 55 relative to the lower body 33.

Referring to FIG. 1*a*, the upper body has an outer portion 73 that is substantially the diameter of the wellhead bore 14. The outer portion 73 depends from the upper body 55. A setting sleeve 75 is carried on the upper body outer portion 73. Setting sleeve 75 is secured by a ring 76 that is fixed to the outer portion 73 so that the sleeve 75 can move axially a limited extent relative to the upper body 55. A key (not shown) causes the setting sleeve 75 to rotate in unison with the upper body 55.

Referring to FIG. 1*b*, the setting sleeve 75 is a tubular member that extends downward from the upper body 55. A threaded ring 77 is located on the lower end of the setting sleeve 75. Threaded ring 77 is a split, ratchet type ring that engages threads in a wedge ring 79. The wedge ring 79 is secured to a metal seal packoff 81 by means of a collar 82. The packoff 81 has a central annular cavity 83 that receives the wedge ring 79.

The setting sleeve 75 will move the packoff 81 from an upper position shown in FIG. 1*b* to a lower position shown in the other figures. In the lower position, the packoff 81 is located in the annular clearance 19 between the casing hanger 17 and the wellhead 11. Furthermore, the setting sleeve 75 will move the wedge ring 79 downward from the upper position shown in FIG. 1*b* to a setting position shown in FIG. 3*b*. In that position, the wedge ring 79 expands portions of the packoff 81 on both sides of the cavity 83 to form a metal seal.

While running the casing hanger 17 in and while cementing, fluid in the riser and wellhead bore 14 is free to flow up through a return flow passage 85 in the setting sleeve 79 and a return flow passage 86 in the upper body 55 (FIG. 1*a*). There are also return flow passages through the casing hanger 17, but these are not shown in the drawings.

The lower body upper portion 49 sealingly locates between the upper body 55 and the setting sleeve 75. This is not a closed chamber, however, as fluid is free to flow out through the passage 87 shown in FIG. 1*a*.

After the upper body 55 has been moved to its lower position shown in FIG. 2*b*, the setting sleeve 75 is then moved downward relative to the upper body 55 to set the packoff 81. This is handled by a setting sleeve piston 89 shown in FIG. 1*a*. The setting sleeve piston 89 is carried in a chamber 90 located between the upper body inner portion 91 and upper body outer portion 73. The setting sleeve piston 89 has seals 92 that will sealingly slide within chamber 90. The chamber 90 of the setting sleeve piston 89 is supplied with a substantially incompressible liquid, such as hydraulic fluid, through hydraulic passages 93. The hydraulic passages 93 communicate with a chamber 95 formed between the bore of the upper body 55 and the exterior of the mandrel 27, as shown in FIG. 1*b*.

A mandrel piston 97 is sealingly carried in the chamber 95. The mandrel piston 97 is integrally formed on the mandrel 27 and protrudes outward. Chamber 95 is sealed by seals 98 on the mandrel piston 97. The hydraulic passage 93 communicates the chamber 95 of the mandrel piston 97 with the chamber 90 of the setting sleeve piston 89. The hydraulic fluid contained in the chambers 90, 95 and passage 93 is sealed from any exterior fluids in the riser (not shown), wellhead bore 14 or within the drill pipe (not shown). Downward movement of the mandrel piston 97 increases the pressure of the hydraulic fluid in the passage 93 to move the setting sleeve piston 89 downward.

The transverse cross-sectional area of the mandrel piston 97, or pressure area, is much less than the cross-sectional area or pressure area of the setting sleeve piston 89. Consequently, the downward force on the mandrel 27 due to the drill string weight is greatly intensified. That is, the downward force exerted by the piston 89 on the setting sleeve 75 will be much higher than the downward force on the mandrel 27, which is limited to the weight of the drill string. Preferably, a sufficient difference exists between the pressure areas to increase a drill string weight on mandrel piston 97 of 20,000 pounds to provide a setting force on the setting sleeve piston 89 of about 500,000 pounds.

Figure 2A:
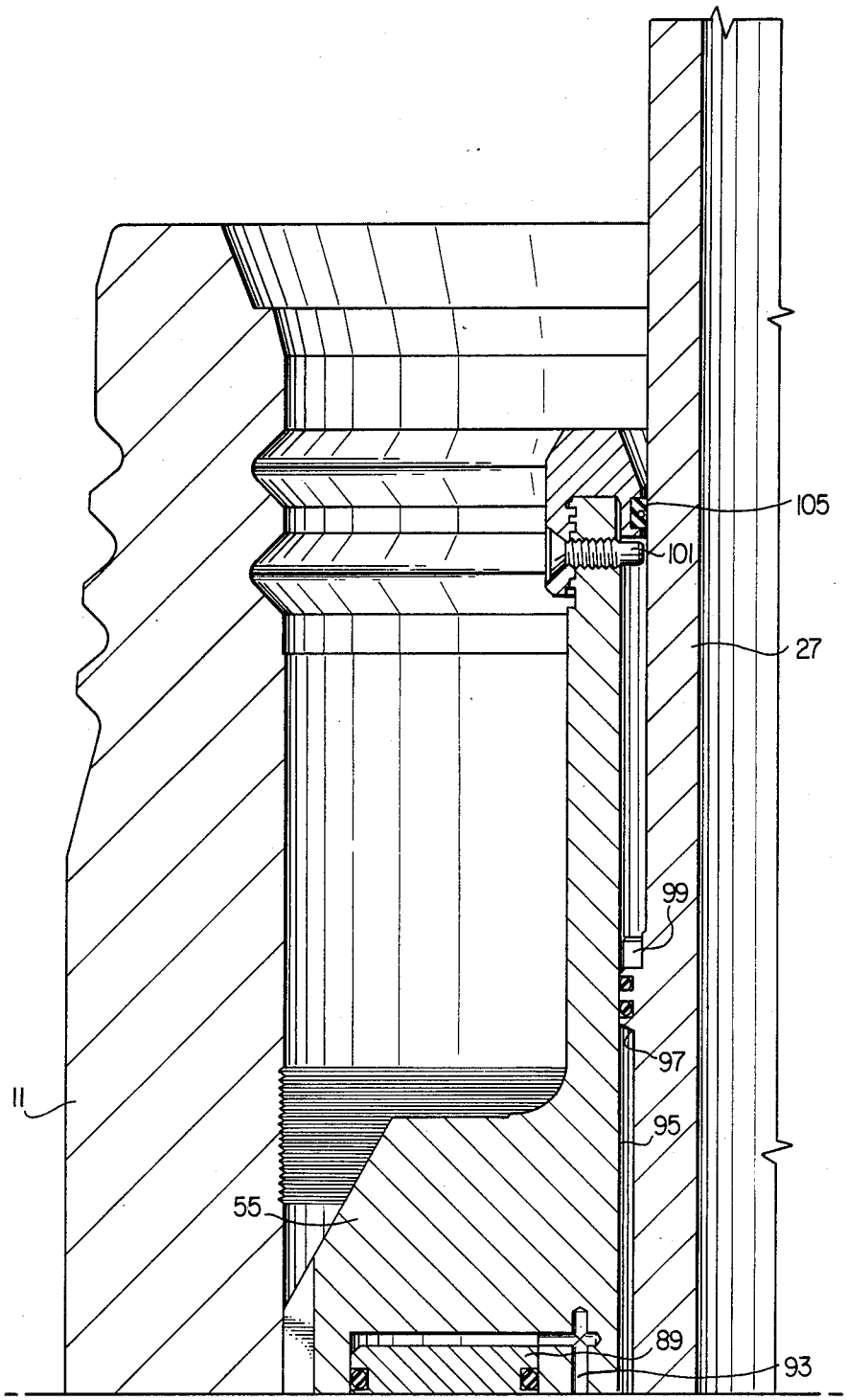
FIGS. 2*a* and 2*b* are quarter sectional views of the running tool of FIG. 1, showing the packoff being moved into position for setting after the casing hanger has been cemented.

Referring to FIG. 2*a*, a series of teeth or castellations 99 are formed on the upper side of the mandrel piston 97. The castellations 99 have slots (not shown) between them that ar adapted to engage a pin 101. Pin 101 is located at the upper end of the upper body 55. Pin 101 is secured in threads in the upper body 55. A collar 103 is located on the upper end of the upper body 55. A wiper seal 105 is positioned between the collar 103 and the outer diameter of the mandrel 27.

In operation, the casing (not shown) will be lowered into the well. The upper end of the casing will be secured to the lower end of the casing hanger 17. As shown in FIG. 1*b*, the running tool 25 will be connected to the casing hanger 17 through the ring 35. The upper end of the mandrel 27 of the running tool 25 is connected to the lower end of a string of drill pipe (not shown). The entire assembly is then lowered into the well until the casing hanger 17 lands on the landing shoulder 13 in the wellhead 11, as shown in FIG. 1*b*.

Then, cement is pumped down the drill pipe. The cement will flow through the bore of the mandrel 27 to the bottom of the casing string, then back up the annulus surrounding the casing string. The returns from the cement will flow through the passages (not shown) in the casing hanger 17, and up through the passages 85 (FIG. 1*b*) and passages 86 (FIG. 1*a*) to the surface through the riser (not shown).

After the cement has set sufficiently, the drill string is rotated to the right. This disengages the threads 31*a*, 31*b* from the lower body 33, as can be seen by comparing FIG. 1*b* with FIG. 2*b*. Once unscrewed, the drill string is lowered, allowing the mandrel 27 to move downward.

As mandrel 27 moves downward, the lower body 33 will remain stationary because it is seated in the casing hanger 17. The upper body 55 will move downward with the mandrel 27. This occurs because the split ring 57 (FIG. 1*b*) retains the upper body 55 with the mandrel 27 for a certain distance. The cam 39 will also move downward with the mandrel 27 for a short distance until it reaches the bottom of cavity 40. The split ring 45 will bear against the top of the cam 39, causing this downward movement. When the cam 39 is in the lower position shown in FIG. 2*b*, the ring 35 will be maintained in the engaged position by means of the upper lobe 41*a*. Once the cam 39 reaches the lower position, the split ring 45 will contract into the recess 47 and slide on past the cam 39.

The downward movement of the mandrel 27 continues until the latch ring 65 (FIG. 1*b*) engages the threads 71 in the lower body 33. When this occurs, the latch ring 65 snaps outward. This allows the split ring 57 to expand outward from the recess 59 in the mandrel 27. The mandrel 27 is then free to move further downward relative to the upper body 55, as illustrated in FIG. 2*b*.

When the upper body 55 is in the lower position, the packoff 81 will be properly positioned in the annular clearance 19 between the casing hanger 17 and the wellhead 11. The upper body 55 will be latched to the lower body 33 so that it can not move upward because of the latch ring 65. This is the position shown in FIG. 2*b*.

Continued downward movement of the mandrel 27 relative to the upper body 55 and lower body 33 causes a pressure increase in the chambers 90, 95 and hydraulic passage 93. The pressure increase acts on the setting sleeve piston 89. The setting sleeve piston 89 acts on the setting sleeve 75. The setting sleeve 75 applies downward force to the wedge ring 79. The wedge ring 79 moves downward into the cavity 83, which sets the packoff 81. The inner portion of the packoff 81 embeds into the casing hanger wickers 21. The outer portion of the packoff 81 embeds into the wellhead bore wickers 15. The setting position is illustrated in FIG. 3*b*. When fully set, the upper end of the setting sleeve 75 will be substantially flush with the upper end of the lower body upper portion 49.

Figure 4A:
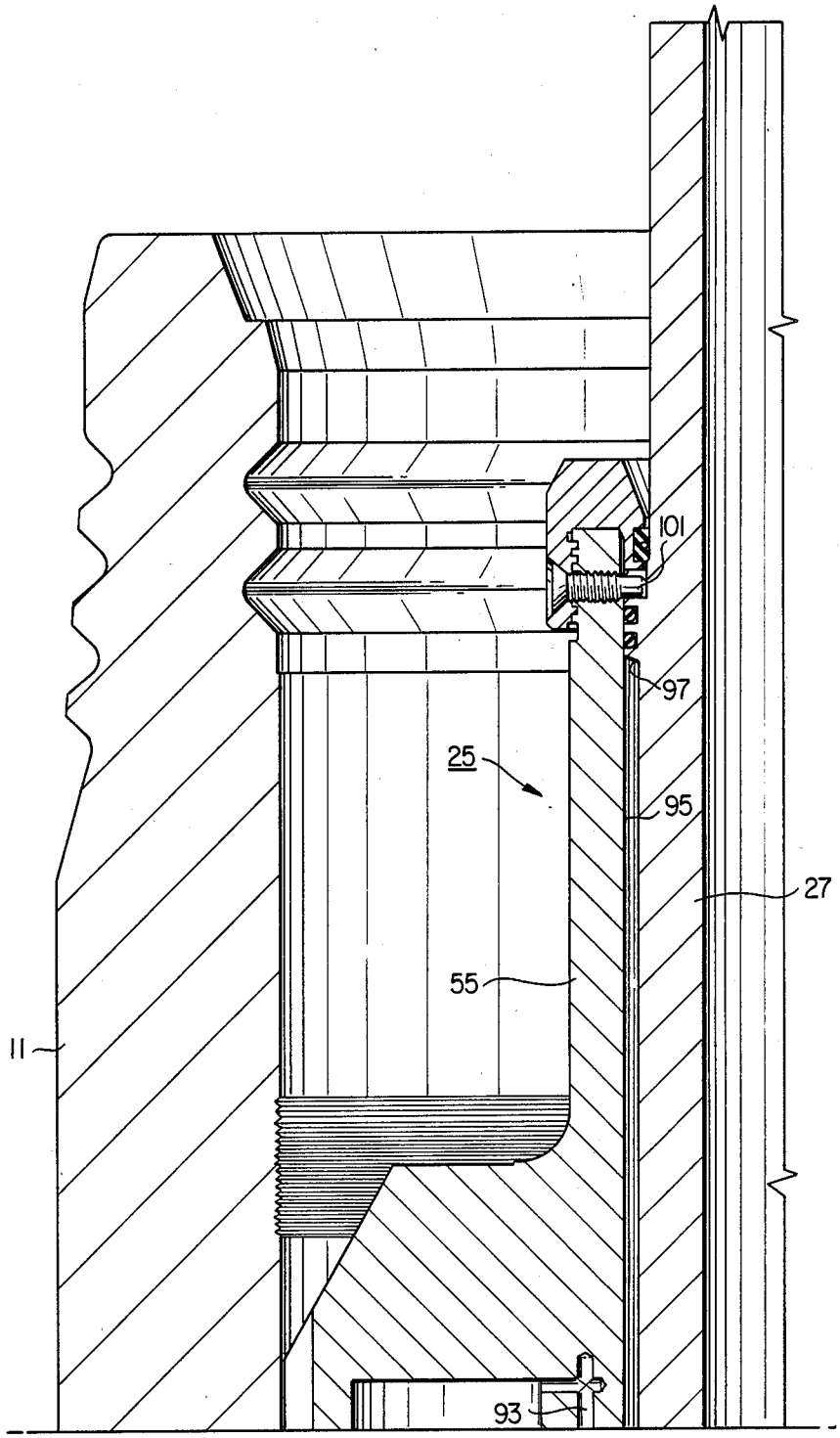
FIGS. 4*a* and 4*b* are quarter sectional views of the running tool of FIG. 1, showing the mandrel moved back to an upper position relative to the upper body to release the running tool from the casing hanger.
Figure 4B:
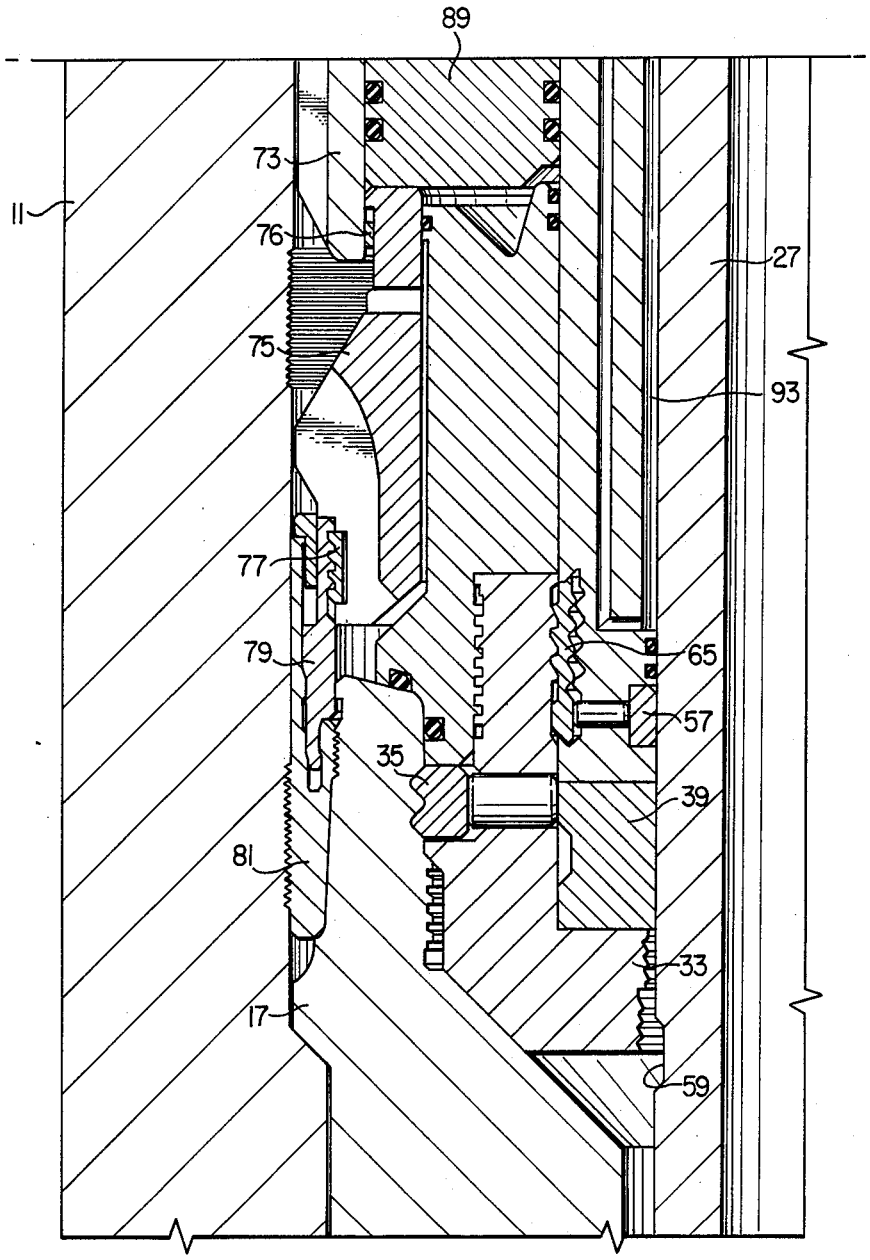

After testing, the running tool 25 may be retrieved from the casing hanger 17. First, the drill string is picked up to pull the mandrel 27 upward. At a certain distance, the castellations 99 (FIG. 2*a*) will engage the pin 101 as shown in FIG. 4*a*. Then, the drill string is rotated to the right again. The mandrel 27 will rotate. The castellations 99 and pin 101 will cause the upper body 55 to rotate with the mandrel 27. This will cause the threaded ring 77 to unscrew from the wedge ring 79. This rotation will also cause the latch ring 65 to unscrew from the threads 71. The mandrel 27 may then be picked up. This is the position shown in FIGS. 5*a* and 5*b*.

As the mandrel 27 is picked up, the recess 59 will move up and engage the split ring 57. This will cause the upper body 55 to begin moving upward with the mandrel 27. The collar 29 will contact the lower side of the cam 39 and move it up to intermediate position shown in FIG. 5*b*. The threads 31*a* and 31*b* will contact the mating threads in the lower body 33 to limit the upward movement of the collar 29 to the position shown in FIG. 5*b*. The intermediate position of the cam 39 allows the ring 35 to retract. The entire running tool 25 may then be pulled to the surface.

In the embodiments of FIGS. 6–9, the elements which are similar to the other embodiment are either not discussed, or when discussed, are indicated with a prime symbol. The principal difference is in the manner of releasing the lower body 33' from the casing hanger 17'. The mandrel 27' is secured by threads to an annular insert 107, which may be considered a part of the lower body 33'. The insert 107 has left-hand threads 108 which secure the insert 107 to the lower body 33'. While downhole, the insert 107 does not unscrew from the lower body 33', rather it is removed and installed only during disassembly and assembly at the surface.

An annular stop 109 is formed on the upper end of the insert 107, extending into the cavity 40' of the lower body 33'. The stop 109 serves as stop means for preventing a cam 111 from moving downward from its lower position shown in FIGS. 6, 7. Cam 111 is axially movable from the lower position shown in FIGS. 6, 7 to the upper position shown in FIG. 8. Cam 111 has a central lobe 113 that pushes outward on link pins 37' and split ring 35' when cam 111 is in the lower position. The lobe 113 maintains the split ring 35' in an engaged position with the casing hanger 17'. When in the upper position of FIG. 8, the lobe 113 passes above the link pins 37', allowing the split ring 35' to retract.

Figure 9:
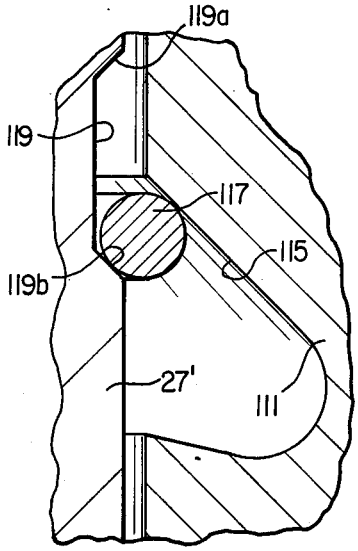
FIG. 9 is a partial vertical sectional view of a portion of the running tool, in the position shown in FIG. 8.

Cam 111 has an inner diameter that slidingly receives the mandrel 27'. An annular slot 115, shown more clearly in FIG. 9, is located in the inner diameter of cam 111. Slot 115 inclines downward and outward relative to the axis of mandrel 27'.

A spring element such as a split ring 117 locates in the slot 115. Split ring 117 has a circular transverse cross-section and is considerably smaller in cross-sectional diameter than the height of the slot 115. Split ring 117 is biased inward into engagement with the mandrel 27'.

A recess 119 is formed on the exterior of the mandrel 27', at a point so that it is initially above the cam 111. As shown in FIG. 9, the upper edge 119*a* and the lower edge 119*b* of the recess are bevelled. The upper edge 119*a* faces downward and outward, and the lower edge 119*b* faces downward and inward.

Figure 7:
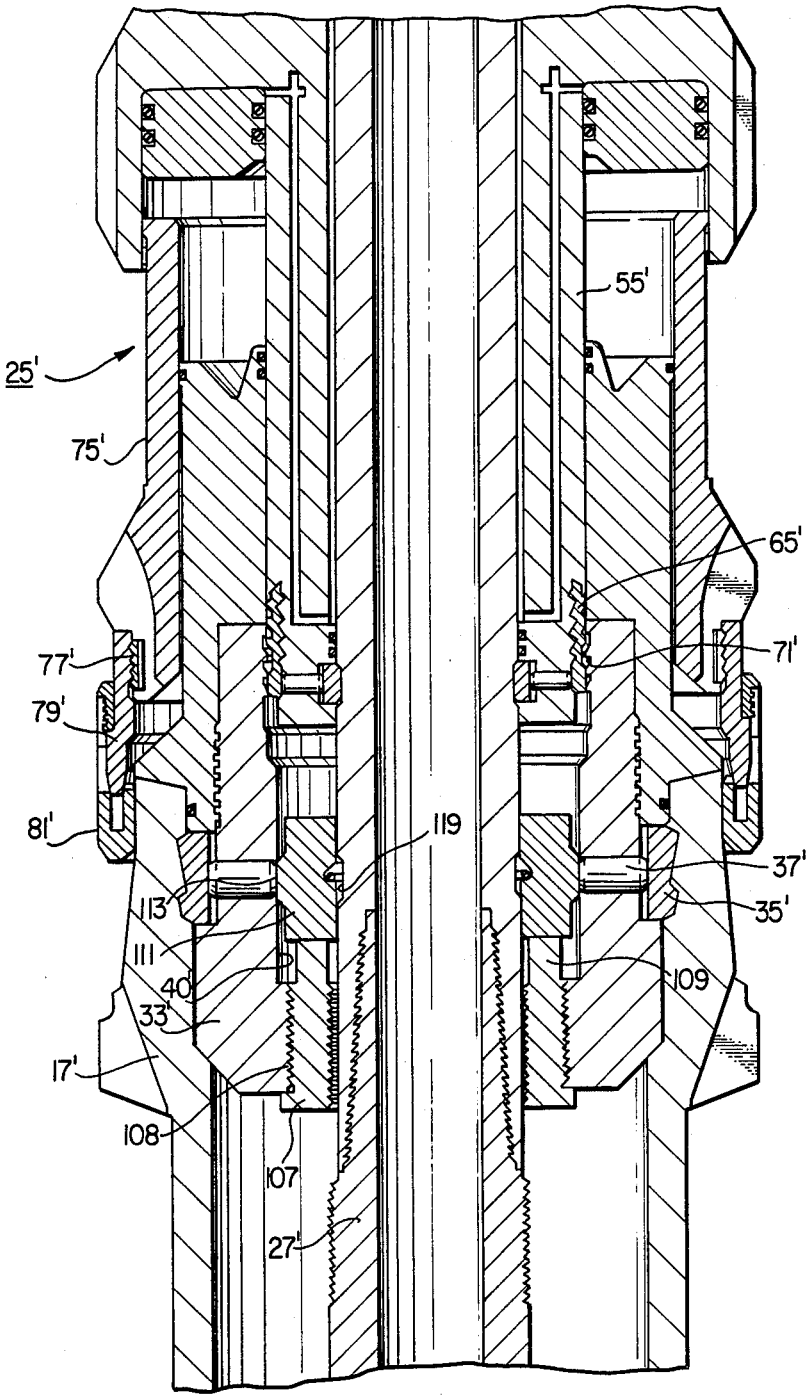
FIG. 7 is a partial vertical sectional view of the running tool of FIG. 6, and shown in a position of lowering the upper body relative to the lower body.
Figure 8:
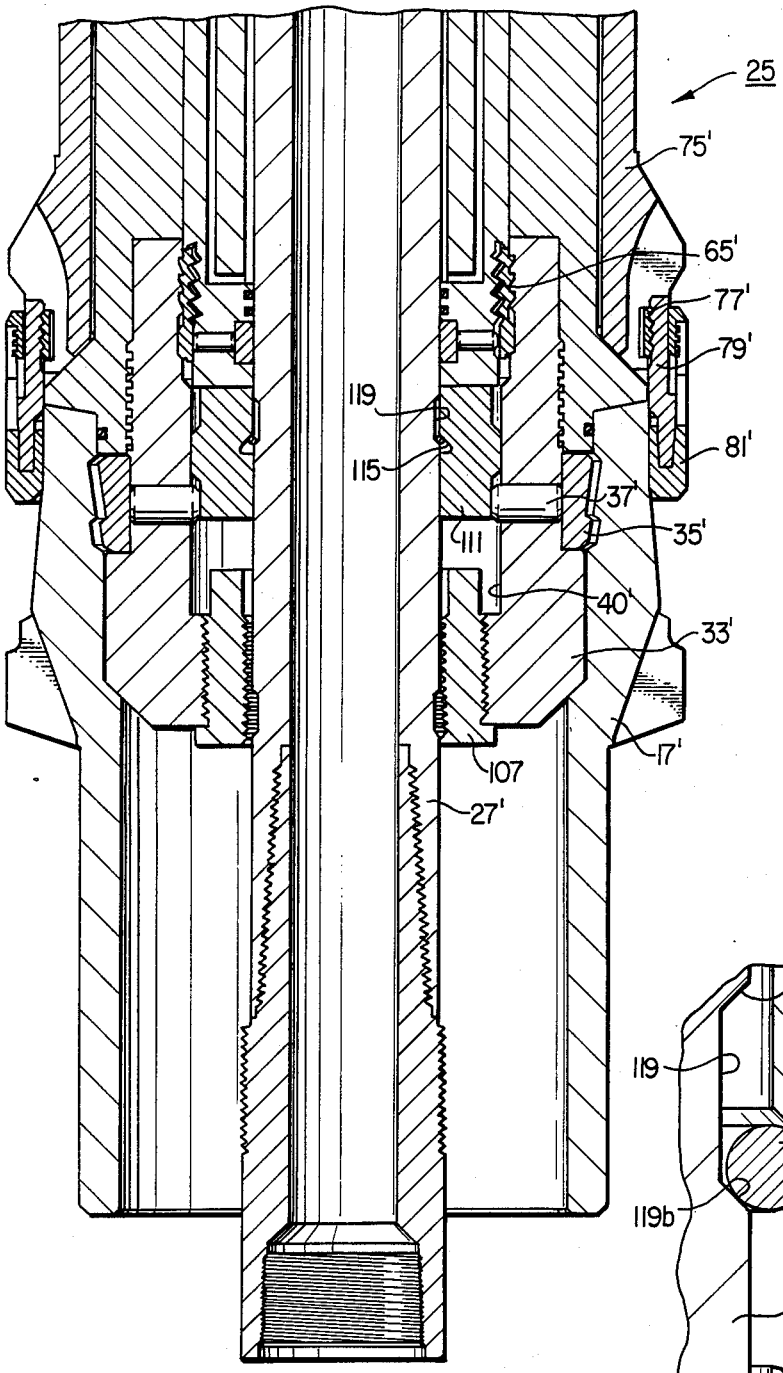
FIG. 8 is a partial vertical sectional view of the running tool of FIG. 6, and shown in a retrieving position.

In operation of the second embodiment, after the cement has set, the drill strig and mandrel 27' are rotated to the right to unscrew the mandrel 27' from the lower body 33'. The insert 107 will not unscrew because of the left-hand threads. As the mandrel moves downward, the cam 111 remains stationary. The recess 119 will slide past the split ring 117, as indicated in FIG. 7. The upper edge 119*a* pushes the split ring 117 outward into the slot 115 as it moves past.

The packoff 81' is set in the same manner as described in the first embodiment. To release the running tool 25', the drill string and the mandrel 27' are picked up. The recess 119 will move up and engage the ring 117. The lower edge 119*b* will push the ring 117 against the inclined upper edge of slot 115. The inclination of the lower edge 119*b* and the upper edge of slot 115 are substantially the same. This traps the ring 117 between the lower edge 119*b* and the upper edge of slot 115. This locks the cam 111 to the mandrel 27 for upward movement.

As the cam 111 moves upward, the lobe 113 passes above the link pin 37'. This allows the ring 35' to retract, releasing the lower body 33' from the casing hanger 17'. The setting sleeve 75' releases from the packoff wedge ring 79' by a straight upward pull. The grooves or threads on the ring 77' are configured to allow releasing with a moderate upward pull. No rotation is necessary.

The upper body 55' will remain in the lower position relative to lower body 33' as the running tool 25' is retrieved to the surface. The latch ring 65' is not unscrewed from the threads 71' until the running tool 25' is at the surface. Consequently, there will be no structure such as the castellations 99 or pin 101 (FIG. 2*a*) for locking the mandrel 27' to the upper body 55' for rotation.

The invention has significant advantages. A high force is achieved by using the differential pistons. This high force enables the setting of metal packoffs. Annulus fluid pressure is not needed. There is no need for dropping balls or darts, or to shift pins in J-slots in order to pump fluid down the drill pipe. The running tool can be released after setting by pulling upward and rotating in one embodiment, or by straight upward pull in the other embodiment.

While the invention has been shown in only two of its forms, it should be apparent to those skilled in the art that it is not so limited, but is susceptible to various changes without departing from the scope of the invention.

We claim:

1. A running tool for setting a packoff in an annular space between a casing hanger and a wellhead, comprising in combination:

a mandrel having an upper end for connection to a string of drill pipe;

a body carried by the mandrel, the mandrel being axially movable relative to the body;

connection means on the body for releasably connecting the body to the casing hanger;

a setting sleeve carried by the body for connection to the packoff;

a setting sleeve piston carried by the body within a setting sleeve chamber for movement relative to the body and positioned to contact an upper end of the setting sleeve;

a mandrel piston carried by the mandrel for movement therewith within a mandrel chamber located between the mandrel and the body, the mandrel piston having a smaller pressure area than the setting sleeve piston;

passage means located in the body sealed from the exterior of the body for communicating the mandrel chamber with the setting sleeve chamber, the setting sleeve chamber above the setting sleeve piston and the mandrel chamber below the mandrel piston containing a substantially incompressible fluid, so that downward movement of the mandrel piston and mandrel relative to the body due to movement of the drill string will increase the pressure of the fluid to exert a downward force on the setting sleeve piston to move the setting sleeve downward to set the packoff; and release means for releasing the connection means from the casing hanger and the setting sleeve from the packoff to allow the tool to be retrieved after the packoff has been set.

2. A running tool for running a casing hanger and setting a packoff in an annulus between the casing hanger and a wellhead, comprising in combination:

a mandrel having means on an upper end for connection to a string of drill pipe;

a lower body carried by the mandrel;

connection means on the lower body for releasably connecting the lower body to the casing hanger;

an upper body carried by the mandrel above the lower body;

a setting sleeve carried by the upper body and adapted to be releasably connected to the packoff;

means for moving the upper body and setting sleeve from an upper position relative to the casing hanger and lower body to a lower position with the packoff located between the casing hanger and the wellhead by downward movement of the drill string and mandrel after the casing hanger has been cemented in place;

latch means for latching the upper body to the lower body when the lower body is in the lower position, to prevent upward movement of the upper body relative to the lower body;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body, the mandrel piston having a smaller pressure area than the setting sleeve piston;

passage means sealed from the annulus and located in the upper body for communicating the mandrel chamber with the setting sleeve chamber, the mandrel chamber containing an incompressible fluid whereby downward movement of the mandrel piston and mandrel due to downward movement of the drill string after the packoff is in the lower position will increase pressure of the fluid to exert a downward force on the setting sleeve piston to move the setting sleeve downward to set the packoff; and release means for releasing the connection means from the casing hanger and the setting sleeve from the packoff to allow the running tool to be retrieved after the packoff has been set.

3. A running tool for running a casing hanger and setting a packoff between the casing hanger and a wellhead, comprising in combination:

a mandrel having a threaded upper end for connection to a string of drill pipe;

a lower body carried by the mandrel;

connection means on the lower body for releasably connecting the lower body to the casing hanger;

an upper body carried by the mandrel above the lower body;

a setting sleeve carried by the upper body and adapted to be releasably connected to the packoff;

mating threads in the mandrel and lower body for releasing the mandrel from the lower body to allow the mandrel to be moved downward relative to the lower body after the casing hanger has been cemented in place and after the drill string is rotated to unscrew the threads;

a locking element located in a recess between the mandrel and the upper body for moving the upper body and setting sleeve downward with the mandrel from an upper position relative to the casing hanger and lower body to a lower position with the packoff located between the casing hanger and wellhead;

latch means on the upper body and the lower body for latching the upper body to the lower body when the lower body is in the lower position to prevent axial movement of the upper body relative to the lower body;

means for releasing the locking element to allow downward movement of the mandrel relative to the upper body when the upper body is in the lower position;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body;

passage means located in the upper body for communicating the mandrel chamber with the setting sleeve chamber, the mandrel chamber containing an incompressible fluid whereby downward movement of the mandrel piston and mandrel due to downward movement of the drill string after the upper body is in the lower position will exert a downward force on the setting sleeve piston to move the setting sleeve downward to set the packoff; and release means for releasing the connection means from the casing hanger and the setting sleeve from the packoff to allow the running tool to be retrieved after the packoff has been set.

4. A running tool for running a casing hanger and setting a packoff between the casing hanger and a wellhead, comprising in combination:

a mandrel having a threaded upper end for connection to a string of drill pipe;

a lower body carried by the mandrel;

connection means on the lower body for releasably connecting the lower body to the casing hanger;

an upper body carried by the mandrel above the lower body, the mandrel being rotatable relative to the upper and lower bodies;

a setting sleeve carried by the upper body and adapted to be releasably connected to the packoff;

mating threads in the mandrel and lower body for releasing the mandrel from the lower body by rotating the drill string to unscrew the threads, to allow the mandrel to be moved downward relative to the lower body after the casing hanger has been cemented in place;

a locking element located in a recess between the mandrel and the upper body for moving the upper body and setting sleeve downward with the mandrel from an upper position relative to the casing hanger and lower body to a lower position with the packoff located between the casing hanger and wellhead;

latch means on the upper body and the lower body, including a split latch ring carried by one of the bodies for ratcheting into and engaging latch grooves carried by the other of the bodies to latch the upper body to the lower body when the lower body is in the lower position, to prevent axial movement of the upper body relative to the lower body;

means connecting the locking element with the latch ring for causing the locking element to move out of the recess when the latch ring engages the latch threads, to allow downward movement of the mandrel relative to the upper body when the upper body is in the lower position;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body;

passage means sealed from the annulus and located in the upper body for communicating the mandrel chamber with the setting sleeve chamber, the mandrel chamber containing a hydraulic fluid below the mandrel piston, whereby downward movement of the mandrel piston and mandrel due to downward movement of the drill string after the upper body is in the lower position will apply pressure to the hydraulic fluid to exert a downward force on the setting sleeve piston to move the setting sleeve downward to set the packoff;

release means for releasing the setting sleeve from the packoff and the lower body from the casing hanger, to allow the running tool to be retrieved after the packoff has been set.

5. A running tool for running a casing hanger and setting a packoff between the casing hanger and a wellhead, comprising in combination:

a mandrel having a threaded upper end for connection to a string of drill pipe;

a lower body carried by the mandrel;

an engaging element carried by the lower body, and movable between an inner retracted position and an outer engaged position in engagement with a groove in the casing hanger for securing the lower body to the casing hanger;

a cam carried by the mandrel in the lower body for axial movement relative to the lower body, the cam having a lower lobe and an upper lobe separated by a cam recess, the cam forcing the engaging element into the engaged position when the lobes are in contact with the engaging element, and allowing retraction of the engaging element to the retracted position when the cam recess engages the engaging element;

an upper body carried by the mandrel above the lower body, the mandrel being rotatable relative to the upper and lower bodies;

a setting sleeve carried by the upper body and adapted to be releasably connected to the packoff;

mating threads in the mandrel and lower body for releasing the mandrel from the lower body by rotating the drill string to unscrew the threads, to allow the mandrel to be moved downward relative to the lower body after the casing hanger has been cemented in place;

retention means for causing the cam to move down from a position with the upper lobe contacting the engaging element to a lower position with the lower lobe contacting the engaging element when the mandrel is moved downward relative to the lower body;

a locking element located in a recess between the mandrel and the upper body for moving the upper body and setting sleeve downward with the mandrel from an upper position relative to the casing hanger and lower body to a lower position with the packoff located between the casing hanger and wellhead;

latch means on the upper body and the lower body, including a split threaded latch ring carried by one of the bodies to ratchet into and engage latch threads carried by the other of the bodies for latching the upper body to the lower body when the lower body is in the lower position, to prevent axial movement of the upper body relative to the lower body;

means engaging the locking element with the latch ring for causing the locking element to move out of the recess when the latch ring engages the latch threads, to allow downward movement of the mandrel relative to the upper body when the upper body is in the lower position;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body;

passage means sealed from the annulus and located in the upper body for communicating the mandrel chamber with the setting sleeve chamber, the mandrel chamber containing an incompressible fluid, whereby downward movement of the mandrel piston and mandrel due to downward movement of the drill string after the upper body is in the lower position will exert a downward force on the setting sleeve piston to move the setting sleeve downward to set the packoff;

means, including a locking pin mounted selectively to one of the mandrel and the upper body for engaging a slot located in the other of the mandrel and upper body when the mandrel is pulled back upward after the packoff has been set, for causing the upper body to rotate with the mandrel when the drill string is rotated, to release the latch ring from the latch threads, and the setting sleeve from the packoff; and means on the mandrel for contacting the cam when the mandrel is pulled upward after the latch ring and setting sleeve are released, and for moving the cam to an intermediate position with the cam recess engaging the engaging element to allow the engaging element to retract, releasing the running tool from the casing hanger.

6. A running tool for running a casing hanger and setting a packoff in an annulus between the casing hanger and a wellhead, comprising in combination:

a mandrel having means on an upper end for connection to a string of drill pipe;

a lower body carried by the mandrel;

an upper body carried by the mandrel above the lower body;

an engaging element carried by the lower body, and movable between an inner retracted position and an outer engaged position in engagement with a groove in the casing hanger for securing the lower body to the casing hanger;

a cam carried by the mandrel in the lower body for axial movement relative to the lower body between lower and upper positions, the cam forcing the engaging element into the engaged position when the cam is in the lower position, and allowing retraction of the engaging element to the retracted position when the cam is in the upper position;

a setting sleeve carried by the upper body and adapted to be releasably connected to the packoff;

means for moving the upper body and setting sleeve from an upper position relative to the casing hanger and lower body to a lower position with the packoff located between the casing hanger and the wellhead by downward movement of the drill string and mandrel after the casing hanger has been cemented in place;

stop means for preventing the cam from moving downward from the lower position when the mandrel moves downward;

latch means for latching the upper body to the lower body when the lower body is in the lower position, to prevent upward movement of the upper body relative to the lower body;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body, the mandrel piston having a smaller pressure area than the setting sleeve piston;

passage means sealed from the annulus and located in the upper body for communicating the mandrel chamber with the setting sleeve chamber, the mandrel chamber containing a hydraulic fluid whereby downward movement of the mandrel piston and mandrel due to downward movement of the drill string after the packoff is in the lower position will increase pressure of the fluid to exert a downward force on the setting sleeve piston to move the setting sleeve downward to set the packoff; and release means for moving the cam to the upper position in response to upward movement of the mandrel after the packoff has been set, to release the engaging element and allow the running tool to be retrieved.

7. A running tool for running a casing hanger and setting a packoff in an annulus between the casing hanger and a wellhead, comprising in combination:

a mandrel having means on an upper end for connection to a string of drill pipe;

a lower body carried by the mandrel;

an upper body carried by the mandrel above the lower body;

an engaging element carried by the lower body, and movable between an inner retracted position and an outer engaged position in engagement with a groove in the casing hanger for securing the lower body to the casing hanger;

a cam carried by the mandrel in the lower body for axial movement relative to the lower body between lower and upper positions, the cam forcing the engaging element into the engaged position when the cam is in the lower position, and allowing retraction of the engaging element to the retracted position when the cam is in the upper position;

the cam having an inner diameter that slidingly engages the mandrel and having an annular slot on its inner diameter;

a setting sleeve carried by the upper body and adapted to be releasably connected to the packoff;

means for moving the upper body and setting sleeve from an upper position relative to the casing hanger and lower body to a lower position with the packoff located between the casing hanger and the wellhead by downward movement of the drill string and mandrel after the casing hanger has been cemented in place;

the mandrel having an annular recess on its exterior positioned to move from above the cam to below the cam as the mandrel moves downward with the upper body;

stop means for preventing the cam from moving downward from the lower position when the mandrel moves downward;

latch means for latching the upper body to the lower body when the lower body is in the lower position, to prevent upward movement of the upper body relative to the lower body;

a setting sleeve piston carried in a setting sleeve chamber in the upper body for movement relative to the upper body and positioned to contact an upper end of the setting sleeve;

a mandrel piston carried by the mandrel for movement therewith in a mandrel chamber located between the mandrel and the upper body, the mandrel piston having a smaller pressure area than the setting sleeve piston;

passage means sealed from the annulus and located in the upper body for communicating the mandrel chamber with the setting sleeve chamber, the mandrel chamber containing a hydraulic fluid whereby downward movement of the mandrel piston and mandrel due to downward movement of the drill string after the packoff is in the lower position will increase pressure of the fluid to exert a downward force on the setting sleeve piston to move the setting sleeve downward to set the packoff; and spring means located in the slot in the cam for locking the cam to the mandrel for upward movement when the spring means is contacted by the recess on the mandrel as the mandrel is moved upward after the packoff has been set, to move the cam to upper position to release the engaging element and allow the running tool to be retrieved.

8. A method for setting a packoff between a casing hanger and a wellhead, comprising in combination:

connecting a mandrel to a string of drill pipe;

mounting a body to the mandrel for axial movement relative to the mandrel;

mounting a setting sleeve to the body and connecting it to the packoff;

mounting a setting sleeve piston in a setting sleeve chamber in the body above an upper end of the setting sleeve;

mounting a mandrel piston to the mandrel for movement therewith in a mandrel chamber between the aandrel and body and providing the mandrel piston with a smaller pressure area than the setting sleeve piston;

providing passages in the body between the mandrel piston and the setting sleeve piston and placing hydraulic fluid in the mandrel chamber; and lowering the drill string, and along with it the mandrel piston and mandrel relative to the body to increase pressure of the hydraulic fluid in the chambers and exert a downward force on the setting sleeve piston to move the setting sleeve downward to set the packoff.

* * * * *